United States Patent [19]

Doublet

[11] Patent Number: 4,984,517

[45] Date of Patent: Jan. 15, 1991

[54] METHOD OF MULTICOLOR PRINTING A MATERIAL

[76] Inventor: Luc Doublet, 80 rue Burgault, Seclin, France

[21] Appl. No.: 912,926

[22] Filed: Sep. 29, 1986

[30] Foreign Application Priority Data

Dec. 27, 1985 [FR] France ..... 85 19523

[51] Int. Cl.[5] ..... B41M 3/00

[52] U.S. Cl. ..... 101/470; 8/471; 101/211

[58] Field of Search ..... 101/470, 211; 8/471

[56] References Cited

U.S. PATENT DOCUMENTS

| | | | |
|---|---|---|---|
| 3,454,764 | 7/1969 | Collier | 101/470 |
| 3,647,503 | 3/1972 | Mizutani | 101/470 |
| 3,649,332 | 3/1972 | Dybvig | 8/471 |
| 3,855,928 | 12/1974 | Kinney | 101/471 |
| 3,868,214 | 2/1975 | Shackleton | 101/470 |
| 4,124,384 | 11/1978 | Centa | 8/471 |
| 4,224,358 | 9/1980 | Hare | 101/470 |
| 4,294,637 | 10/1981 | Rump | 8/471 |
| 4,465,489 | 8/1984 | Jenkins | 8/471 |

FOREIGN PATENT DOCUMENTS

| | | | |
|---|---|---|---|
| 232082 | 9/1959 | Australia | 101/470 |
| 30890 | 3/1981 | Japan | 101/470 |
| 93192 | 6/1982 | Japan | 101/470 |
| 204985 | 11/1984 | Japan | 8/471 |

*Primary Examiner*—Clifford D. Crowder
*Attorney, Agent, or Firm*—Sandler, Greenblum & Bernstein

[57] ABSTRACT

This method of printing a material consists in decorating the material with a multicolor design or composition consisting of an assembly of elementary primary forms such any desired geometrical forms, numeral and letters having each a primary color, this multicolor design being composed preliminarily on a provisional carrier from inks adapted to be transferred to the material under the combined action of heat and pressure. A basic bundle of colored sheets is formed by stacking one or a plurality of sheets having one flat face covered with sublimable ink. The sheets are cut simultaneously to the contours of the elementary forms of the decorative design with respect to the peripheral contour of the material, each or all the sheets having consequently a cut area corresponding to the elementary forms of the final design. The multicolor decorative design is composed on a provisional carrier by superposing and/or juxtaposing the precut elementary primary forms which are taken from the sheet having the corresponding primary color, and the thus composed multicolor design is transferred from the provisional carrier to the material to be decorated while maintaining a close contact, by pressure, between the provisional carrier and the material and heating the assembly in order to sublimate the inks and cause an accurately positioned diffusion of the inks in the material.

21 Claims, 2 Drawing Sheets

5

METHOD OF MULTICOLOR PRINTING A MATERIAL

BACKGROUND OF THE INVENTION

1. FIELD OF THE INVENTION

This invention relates to a method of printing a material. More particularly, the present invention is directed to provide a method permitting of decorating a wide range of materials with a multicolor design, text or pattern formed beforehand and consisting of an assembly of elementary forms, signs and/or symbols.

The method of this invention is applicable notable to the manufacture of flexible articles such as flags or upholstery hangings. However, this method may also be used for decorating other articles such as semi-rigid or rigid sheet material, for example paperboard, cardboard or metal sheets.

2. THE STATE OF THE ART

Various methods of decorating miscellaneous materials have already been proposed which permit of reproducing any desired multicolor design on the material to be printed. In fact, printing methods such as serigraphy or other known methods such as the so-called sublistatic processes consisting in transferring to a material by the combined action of heat and pressure a multicolor design made beforehand on a temporary support from inks adapted to be transferred by sublimation are already known in the art.

However, in this last case the multicolor backgrounds are obtained beforehand by using various known printing methods. As a rule, these impressions are made in great numbers acccording to well-defined and fixed characteristics, colors and designs.

Therefore, these methods are either awkward to carry out, notably in the case of serigraphy which involves the use of various serigraphic frames constituting separate masks for each color to be deposited, the frame size depending on the designs to be obtained, or requiring the printing of a relatively great number of prints for amortizing costs and making the preliminary printing of designs or patterns with sublimable inks pay for itself.

It must be understood that the printing process must be easy to use and adapted to a number of copies to be made. The process of the present invention is suited both to large and small series. This is notably the case when printing upholstery textile material such as hangings and in the manufacture of flags, banners or the like. Experience teaches that in this specific field conventional techniques are scarcely advantageous and rather ill-suited for the purpose.

On the other hand, in the manufacture of flags or similar articles well-defined properties are required. In fact, the appearance must be spotless and light-weight materials are preferred to warrant a satisfactory waving in the wind. Besides a good strength is necessary for both the material and the printing.

Moreover, other problems associated with quality requirements arise due on the one hand to the number of different important designs and on the other hand to the manufacture of relatively small series of articles. In addition, these articles are manufactured in a relatively wide range of shapes and sizes.

These contradictory requirements prove that conventional or hitherto known methods are not capable of providing a satisfactory compromise so as to meet all of them. In fact, in the case of serigraphy a relative great number of frames adapted for each type of flag and to each flag size must be available, so that manufacturers are confronted with difficult problems concerning the cost and storage of the frames.

On the other hand, though the sublistatic printing method has some very attractive features, its adaptability and flexibility are so far not sufficient for obtaining different multicolor patterns or designs as required.

It is for this reasons that many flags are still made of an assembly or patchwork of sewn and embroidered textile elements. This type of manufacture, though irreproachable, is objectionable on account of its excessive cost. Now in the present state of the trade, there is an increasing demand for flags or like articles notably for transmitting advertising messages, and therefore it is absolutely necessary to facilitate the manufacture of flags or the like and to reduce their cost.

SUMMARY OF THE INVENTION

It is the primary object of the present invention to provide a method of printing a material, wherein the material is decorated with a multicolor design, this method being applicable notably to the manufacture of flexible articles such as flags or upholstery textile articles, such as hangings, while meeting the above-mentioned requirements and avoiding the above-mentioned inconveniences.

It is another object of the present invention to provide a method of printing a material which permits of decorating the material with a multicolor design formed beforehand by composition, thus permitting the creation of any desired design.

Furthermore, it is one object of this invention to provide a method of printing a material which is capable of preserving the advantageous features of the so-called sublistatic impression while permitting any desired variations in the shapes, colors and relative arrangements of the designs or patterns.

In fact, with the method of the present invention extremely diversified impressions can be made and any desired original compositions and sizes may be contemplated without necessarily resorting to stencil plates or a great number of models kept in stock for each type of impression to be made.

Another object of the invention is to provide a method of printing a material which is adaptable for printing flexible articles either one by one or in limited series or numbers.

An additional object of the present invention is to provide a method of printing a material which permits the making of aesthetically perfect decorated articles having a considerable mechanical strength.

Other objects and advantages of the present invention will appear as the following description proceeds with reference to the attached drawings showing by way of examples various typical forms of embodiment of the invention.

The method of printing a material according to the present invention, which is intended notably for making flexible articles such as flags or textile hangings, and consists essentially in decorating the material or article with a multicolor design or pattern consisting of an assembly of primary elementary signs, such as any geometrical figures, letters or numerals having each a primary color, said multicolor design being formed beforehand on a temporary support from inks adapted to be transferred to said material be the combined action of heat and pressure, is characterised by the fact that:

a basic bundle of colored sheets is formed by stacking one or a plurality of sheets covered on one flat side with sublimable ink, said bundle comprising at least one sheet of each primary color required for obtaining the final multicolor design, on each sheet of the bundle the contours of the elementary forms of the decoration or design are formed simultaneously by cutting, with respect to the external contour of the material to be decorated, all the sheet having the same precut areas corresponding to the elementary shapes of the final design, on a provisional support the multicolor design is composed by superposing and/or juxtaposing precut elementary primary shapes, said primary shapes being cut in the corresponding primary color sheet;

the thus composed multicolor design is transferred from the provisional support to the material to be decorated by maintaining a close contact under pressure between said provisional support and said material, with the application of heat, so that the inks will be sublimated and diffused in said material under proper position control conditions.

THE FIGURES

Figure 1:
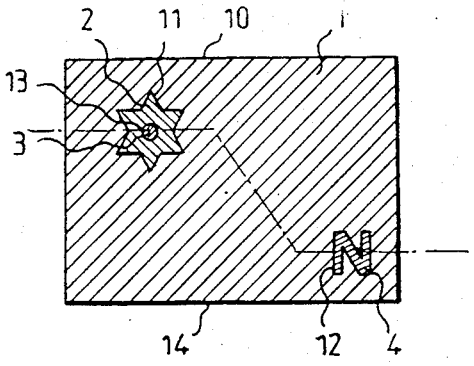
FIG. 1 is a front view of a finished material decorated according to the method of the present invention.
Figure 2:
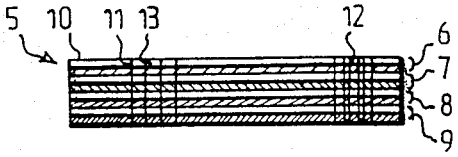
FIG. 2 is a section taken along the broken line of FIG. 1 showing a basic bundle of colored sheets required for carrying out the method of the present invention and obtaining the decorated material of FIG. 1.
Figure 3A:
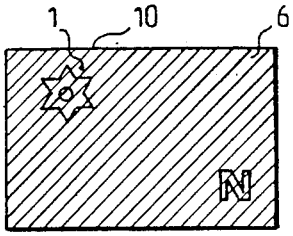
Figure 3B:
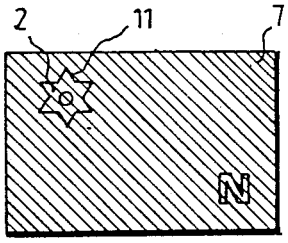
Figure 3C:
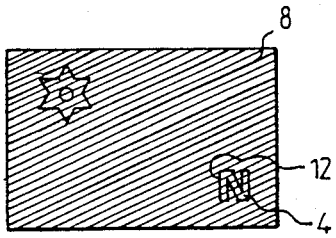
Figure 3D:
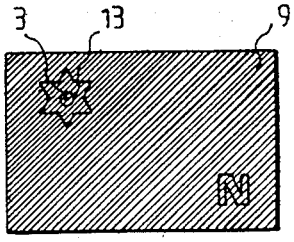
Figure 4:
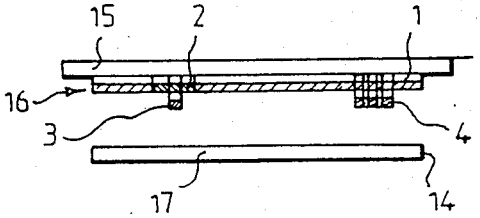
Figure 5:
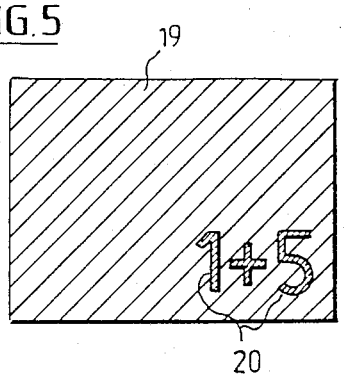
Figure 7:
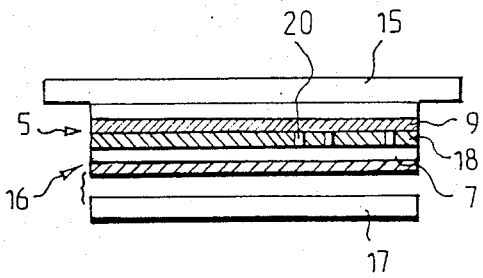
Figure 6A:
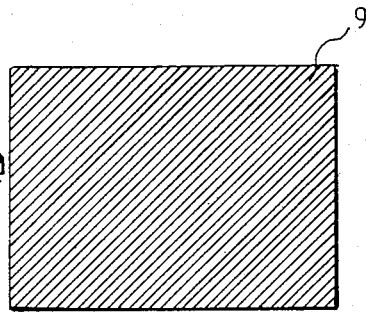
Figure 6B:
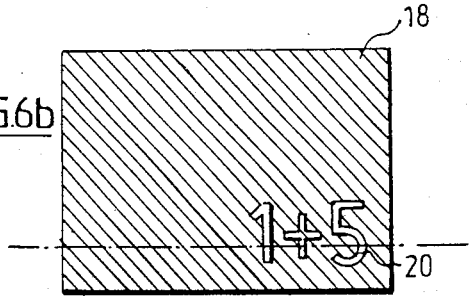
Figure 6C:
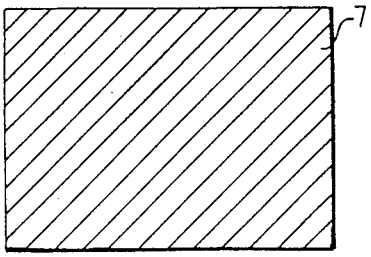

FIGS. 3*a*–3*d* are detail views showing the composition of the bundle illustrated in FIG. 2;

FIG. 4 is another sectional view showing a specific phase of the printing method of the invention, namely the composition of the design on the background of FIG. 1 before its transfer to the material to be decorated;

FIG. 5 illustrates another configuration of the finished material decorated according to the printing method of the present invention;

FIGS. 6*a*–6*c* illustrate the composition of the bundle which is necessary for carrying out the printing method of the present invention and obtaining the material shown in FIG. 5, and FIG. 7 shows one phase of the method of this invention which illustrates the composition of the multicolor design before transferring this design to the material and obtaining the article shown in FIG. 5.

DESCRIPTION OF THE PREFERRED EMBODIMENT

The present invention is directed to a method of printing a material so as to decorate it with a single multicolor impression. Preliminary to the printing proper, the composition is formed on a provisional carrier by using inks adapted to be transferred to said material by the combined action of heat and pressure, a process more generally referred to by the man of the Art as the sublimation or sublistatic printing method.

Thus, by using the printing method of the present invention, it is possible to decorate notably flexible articles such as upholstery hangings or flags. FIGS. 1–5 of the drawings illustrate two typical and non-exhaustive forms of embodiment of flags decorated according to the method of the present invention. However, other applications may be contemplated without departing from the basic principles of the invention.

FIG. 1 shows the appearance of a flag consisting of a flexible textile material decorated with a multicolor pattern consisting of an assembly of primary elementary signs, such as any desired geometrical forms or shapes, letters or numerals having each a primary color.

More particularly, FIG. 1 shows a flag of which the background 1 is colored and carries at well-defined locations elementary primary signs such as a colored star 2, a colored patch 3 and a colored letter 4. Of course, the background 1, and star 2, patch 3 and letter 4 have different colors so as to stand out from one another according to the particular effects contemplated by the manufacturer or the user.

The various colors constituting the decorated material are referred to herein as the primary colors, and there are as many primary colors as colors or shades in the final multicolor design or composition.

In FIGS. 1–4 illustrating the method of printing a material according to the present invention four different colors are used and designated by different kinds of hatching, but of course this definition is given by way of example only since a smaller or greater number of colors may be used, if desired.

According to the printing method of the present invention, the following four essential and sequential steps are carried out in actual practice:

(a) a basic bundle 5 consisting of one of a plurality of sheets 6–9 colored on one flat face with a sublimable ink is formed, this bundle 5 comprising at least one sheet of each primary color as required for obtaining the final multicolor composition:

In the case of FIGS 1–4, this bundle 5 comprises four sheets 6–9 respectively, each flat-tinted with four sublimable inks of different colors which are the colors of the background 1, of the star 2, of the letter 4 and of the patch 3, respectively. It will be seen that in this stage of the process the position of the colors is immaterial; however, this position must be considered as a function of specific requirements as described hereinafter.

(b) Then, the contours 10–13 of the component elements 1–4 of the final design, which are superposed in the bundle 5 and constitute the final design with respect to the outer or peripheral contour 14 of the material to be decorated, are cut simultaneously in each sheet 6–9 so that each sheet 6–9 has the same precut areas corresponding to the component elements 1–4 of the end design.

In the example illustrated, the various precut areas corresponding to the primary elements 1–4 of the final design are clearly apparent, these areas being superposed in the bundle 5 as shown in FIG. 2. On the other hand the bundle of the exploded views of FIGS. 3*a*–3*d* shows the various colored sheets 6–9 on which the signs 10–13 are cut simultaneously, each sheet having cut therein all the contours 10–13 of the primary elements 1–4.

(c) Subsequently, on a provisional carrier, of a size greater than that of the material to be decorated, the final multicolor design is composed, such as illustrated notably in FIG. 1, by superposing and/or juxtaposing the precut primary elementary signs 1–4 taken from the corresponding primary color sheets designated by the reference numerals 7, 9 and 8, respectively. This composition is shown notably as a typical form of embodiment in FIG. 4.

(d) Finally, the multi-background multi-element design 16 thus composed is transferred from the provisional carrier 15 to the material 17 to be decorated. For this purpose, the conventional so-called sublistatic technique is used, that is, said provisional carrier 15 and said material 17 are kept under close contact by pressure so that the inks will be sublimated and diffused through the material 17 in order to constitute the final design as illustrated notably in FIG. 1.

Moreover, according to the present invention, to preserve the relative positioning between the sheets 6–9 during the cutting of the contours 10–13 of the component elements 1–4, suitable means are provided on one side of each colored sheet 6–9.

More particularly, and according to a preferred form of embodiment, to maintain the relative positioning of the sheets 6–9, one can utilize an adhesive applied to the surface of each of the sheets. However, as the adhesive will be inevitably in contact with the sublimable ink, the adhesive will have a chemical composition compatible with that of the sublimable ink so as not to adversely affect the inks, or cause anomalies during transfer, in other words, so as to have a faultless, impeccable, final product. The adhesive should have a good resistance to pressure, heat and being furthermore strippable.

Thus, these adhesive coatings will not affect the transfer and more particularly the migration of the coloring matters from the provisional carrier 15 to the material 1 to be decorated. On the other hand, said coatings will also facilitate the separation of the colored sheets 6–9 which is required for performing the composition, on the provisional carrier 15, of the multicolor decoration or design by superposing or juxtaposing said precut component elements 1–4.

Besides, according to the present invention, the contours 10–13 of the elementary component elements 1–4 of the final decoration are cut with respect to the outer contour 14 or periphery of the material to be decorated by laser cutting performed through the compact bundle 5.

However, other cutting techniques may be contemplated, for example the cutting by means of ultrasonic waves. These two techniques are generally known to those conversant with the art and therefore are no part of the present invention.

Nevertheless, it is advantageous to use a digital-controlled cutting device for on the one hand memorizing all the contours of the decoration contemplated according to a preselected pattern, and on the other hand having the possibility of reproducing these cuttings indefinitly and as desired by the operator.

Since the use of laser cutting means involves compulsorily the provision of efficient cooling and ventilation means and constitutes a source of turbulence in the cutting area, a proper operation of the method of the present invention will require means for reliably holding the colored sheets 6–9 to prevent any undesired relative slipping thereof during the cutting steps as described hereinabove.

On the other hand, practical tests proved that very satisfactory results can be obtained with the laser cutting method. To cut out the colored sheets 6–9 of the bundle by the laser apparatus, one places the bundle upside-down, that is, one strikes the side of the sheets not covered with sublimable ink. Moreover, in this case an appreciable advantage is obtained in that the normal image of the flag is obtained, thus avoiding the difficulties experienced when reproducing its inverted image.

Moreover, according to the power rating of the cutting means, especially in the case of a laser device, when one has several flags of the same type to be made, one may superpose the bundles, so that the complete assembly of superposed sheets can be cut simultaneously by the laser beam. Thus, several copies of the bundles can advantageously be prepared for obtaining series of materials decorated according to the method of the present invention.

With a laser cutting device of a known, commercially available type it is possible to cut up to about 250 sheets on a single operation, to constitute the bases of, say, 50 identical flags having a five-color design or composition printed thereon.

By using the above-described technique, it will be seen that according to the colors and ink qualities contemplated it is possible to compose the multicolor decorated design 16 in different ways.

As a rule, according to the present invention, the multicolor design or decoration 16 can be composed on the provisional carrier 15 by taking from the bundle 5 the component elements 1–4 of the final design precut from each colored sheet 6–9 having the corresponding primary color to constitute and form, by juxtaposing and/or superposing precut elementary forms 1–4, the various colored areas of the final design or picture. Due to the simultaneous cutting of the bundle 5, it will be seen that the elementary component elements depart and position themselves perfectly with respect to one another, whereby the operator or compositor is not confronted with the task of controlling and detecting other separate reference marks as currently observed in the serigraphic process.

Furthermore, according to the present invention, the thus positioned different forms 1–4 are kept in position by fixing them on the provisional carrier 15 by means of adhesive means consisting advantageously of an adhesive coating having the same composition and properties as the adhesive used in a prior step for preserving the relative positions of the sheet in the bundle.

According to the properties of the pigments constituting the colored sublistatic inks and the various shades and colors implemented, it is advisable to comply with certain rules governing the superposition of different colors, to prevent for example some so-called "stronger" colors from passing through so-called "weaker" colors.

Thus, for instance, dark colors such as black, blue, red will easily pass through and mask a clearer color such as yellow. In this case, one should avoid superposing yellow elements to darker elements. On the other hand, dark elements can be superposed to clearer color forms without any inconvenience.

A typical composition illustrating the juxtaposition and the superposition of different colors is shown in FIG. 4. Assuming that the elementary form 2 has a clear color such as yellow, it will not be superposed to an elementary from 1 of darker color such as red, so that the area precut in the red sheet 6 constituting the flag background will be removed and replaced by the yellow elementary form 2 corresponding to the final design.

On the other hand, in the case of darker colors, it is not compulsory to substitute the elementary forms. They can be superposed, for example, as shown in FIG. 4, the elementary form 4 being superposed to the elementary form 1, the same applying to form 3 in relation to form 2.

However, other combinations could be contemplated and in certain cases this color overwhelming may be exploited for making inscriptions.

FIG. 5 illustrates a material decorated according to a different color arrangement. This material comprises notably dark-colored inscriptions on a clear background.

According to the quality and color of the inks, and also to the characteristic features of the design to be reproduced, it is possible to decorate the material or obtain primary forms by interposing one or several neutral sheets 18 in the bundle 5, said neutral sheets 18 being free of any sublimable ink and constituting barrier such as 7 and 9 in the specific case illustrated in the Figure for preventing the inks from flowing between the sheets bearing primary colors, and avoid any mixing of said inks.

FIG. 6 shows a bundle 5 consisting for instance of two sheets of primary colors, namely a clear sheet 7 and a dark sheet 9, with a neutral sheet 18 disposed therebetween.

The purpose of this operation is therefore to obtain dark inscriptions 20 on a clear background 19. As explained hereinabove, some dark colors tend to pass through clear colors. Under these conditions, this feature may advantageously be exploited for obtaining said inscriptions 20.

However, to prevent darker inks from masking the clear background completely, a neutral sheet 18 acting as a mask and having inscriptions 20 cut therein is preferably sandwiched therebetween.

When manufacturing a flag displaying inscriptions such as those illustrated in FIG. 5, the same procedure as that described hereinabove may be adhered to. During the ink transfer step, the dark inks of the primary sheet 9 expand through the screen 18 in the areas of cuttings 20 and subsequently predominate the clearer color of sheet 7, and eventually form the desired inscriptions on the material 17 to be decorated.

It will be seen that the cutout portions may be formed simultaneously through the bundle in which one or a plurality of neutral sheets 18 are inserted. However, when inscriptions comprising cutout portions of relatively great size are comtemplated, it will be advantageous to avoid making these cuttings in some of the sheets 6–9 constituting the bundle 5 and to form them only in the neutral sheets 18. This possibility may be choosen notably by the operator during the manufacture according to the specific features characterising the decorative design or composition.

When the composition of the decorating design is completed according to the teachings of the present invention, as shown in FIG. 7, the conventional so-called sublistatic technique is applied.

In fact, the multicolor decorative design 16 previously formed on the provisional carrier 15 is transferred:

by applying the provisional carrier 15 onto the material 17 to be decorated, by causing the inks to migrate from the provisional carrier 15 to the material 17, by the combined action of heat and pressure, in a sublimation press of the flat or calendar type, and by substituting the provisional carrier 15 upon completion of the ink transfer step.

It may be pointed out that very good results have been obtained by using pressures of the order of 1 to 5 kg/sq.m. at a temperature in the range of 170° to 220° C. during a time ranging from a few seconds to several minutes.

In the particular case of flag manufacture, the material 17 to be decorated consists of a flexible, light and very strong material such as natural or synthetic textile material, colored or not, for example a polyester fabric weighing 50 to 200 gr/sq.m.

However, this material may consist of any support capable of fixing sublimate inks. More particularly, it may consist of cardboard sheets or metal sheets.

Of course, other applications and forms of embodiment may be imagined by those conversant with the art without departing from the basic principles of the invention, therefore, within the scope of the following claims.

What is claimed as new is:

1. A method of printing a material, notably in the manufacture of flexible articles such as flags or upholstery hangings, wherein a material is decorated with a multicolor design consisting of an assembly of primary elementary forms, for example geometric forms, letters or numerals having each primary color, said multicolor design being formed preliminarily on a provisional carrier from inks adapted to be transferred to said material by the combined action of heat and pressure, said method comprising the steps of:

forming a bundle of colored sheets by stacking a plurality of sheets flat tinted on one side with sublimable ink, said bundle comprising at least one sheet of each primary color necessary for obtaining the final multicolor design, forming simultaneously by cutting each sheet of said bundle the contours of the elementary forms of said decorative design with respect to the outer periphery or contour of the material to be decorated, each sheet being thus provided identically with precut areas corresponding to the elementary forms of the final design, composing on a provisional carrier the multicolor decorative design by superposing and/or juxtaposing precut primary elementary forms taken from the corresponding primary color sheet, and transferrring the thus composed multicolor design from said provisional carrier to the material to be decorated while maintaining a close contact by pressure between said provisional carrier and said material, and heating the material for sublimating the inks and diffusing the inks in the material under accurate position control conditions.

2. The printing method of claim 1, wherein means are provided on one flat side of each colored sheet of said bundle for accurately preserving the relative positions of said sheets during the cutting step.

3. The printing method of claim 2, wherein said means for preserving the relative positions of said sheets consist of adhesive coatings compatible with sublimable inks and capable of withstanding the action of heat and pressure, said coating being furthermore strippable.

4. The printing method of claim 1, wherein all the contours of the design and of the material to be decorated by cutting said bundle are formed simultaneously on each sheet by laser cutting said bundle.

5. The printing method of claim 1, wherein all the contours of the design and of the material to be decorated by cutting said bundle by means of a supersonic device are formed simultaneously on each sheet of said bundle.

6. The printing method of claim 1, wherein a plurality of said bundles consisting of basic colored sheets are superposed, each bundle being adapted to form the multi-back-ground design of a same type of final design on said material, all the superposed sheets of said bundles being cut simultaneously.

7. The printing method of claim 1, wherein the multi-color decorative design is composed beforehand on a provisional carrier by taking from a bundle the precut primary elementary forms from each primary colored sheet to constitute and form, by juxtaposition and/or superposition of said forms, the different colored areas of the final design, each elementary form being positioned with precision due to the simultaneous cutting of said bundle.

8. The printing method of claim 7, wherein the various precut primary elementary forms are fixed to said provisional carrier by using adhesive means.

9. The printing method of claim 7, wherein, according to the quality of the print, the ink colors and the characteristics of the design to be reproduced, one or several neutral sheets are introduced into said bundle, said neutral sheets being free of any sublimable inks and acting as a barrier to the inks of the primary color sheets thus separated to prevent said inks from intermixing during the transfer step.

10. The printing method of claim 1, wherein said material to be decorated consists of any support adapted to fix sublimable inks, such as a natural or synthetic textile material.

11. A method of forming an apparatus for printing a multi-color design of at least one shape on a material comprising the steps of:

(a) providing a bundle of sheets adapted for multi-color transfer to said material;
(b) forming cutout portions in said bundle corresponding to each shape to be printed; and
(c) selectively juxtaposing and superposing said cutout portions to form areas of different color for transfer to said material.

12. A method of forming an apparatus according to claim 11 wherein said step of providing a bundle of sheets includes applying a different color of ink to each sheet of said bundle prior to stacking said sheets into said bundle.

13. A method of forming an apparatus according to claim 12 wherein at least one of said sheets is a barrier layer.

14. A method of forming an apparatus according to claim 11 wherein said step of forming cutout portions includes simultaneously cutting said cutout portions from each said sheet.

15. A method of forming an apparatus according to claim 11 wherein said step of providing a bundle of sheets includes applying adhesive to each said sheet.

16. A method of forming an apparatus according to claim 15 wherein said step of selectively juxtaposing and superposing includes selectively stripping cutout portions from said bundle of sheets.

17. A method of forming an apparatus according to claim 16, further comprising affixing said bundle of sheets to a carrier for supporting said bundle of sheets prior to juxtaposing and superposing.

18. A method of printing a multi-color design of at least one shape on a material comprising the steps of:

(a) providing a bundle of sheets adapted for multi-color transfer to said material;
(b) forming cutout portions in said bundle corresponding to each shape to be printed;
(c) selectively juxtaposing and superposing said cutout portions to form areas of different color; and
(d) transferring each said different color simultaneously to said material to print said multi-color design.

19. A method of printing a multi-color design according to claim 18 wherein said multi-color design includes a plurality of colors wherein at least one color is strong and at least one color is weak relative to each other and wherein said step of selectively juxtaposing and superposing said cutout portions includes juxtaposing said cutout portion the color of which is weak, and superposing cutout portions, the color of which is strong.

20. A method of printing a multi-color design according to claim 18 wherein at least one of said sheets is a barrier layer and wherein said step of selectively juxtaposing and superposing consists essentially of selectively superposing.

21. A method of printing a multi-color design according to claim 18 wherein said step of forming a bundle includes applying a different color of ink to each sheet of said bundle and wherein said step of transferring includes:

(a) applying pressure to said bundle of sheets and said material;
(b) heating said material; and
(c) diffusing said each different color of ink into said material.

* * * * *